US007715745B2

(12) United States Patent
Ahn et al.

(10) Patent No.: US 7,715,745 B2
(45) Date of Patent: May 11, 2010

(54) IMAGE FORMING APPARATUS HAVING REMAINING TONER REMOVING PART AND METHOD OF REMOVING REMAINING TONER THEREFROM

(75) Inventors: Byung-sun Ahn, Suwon-si (KR); Jeong-yong Ju, Suwon-si (KR); Oh-dug Kwon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 183 days.

(21) Appl. No.: 11/940,083

(22) Filed: Nov. 14, 2007

(65) Prior Publication Data

US 2008/0152373 A1 Jun. 26, 2008

(30) Foreign Application Priority Data

Dec. 20, 2006 (KR) ..... 10-2006-0131204

(51) Int. Cl.
*G03G 15/16* (2006.01)

(52) U.S. Cl. ..... 399/66; 399/101

(58) Field of Classification Search ..... 399/101, 399/66, 71, 299

See application file for complete search history.

(56) References Cited

U.S. PATENT DOCUMENTS

| | | | | |
|---|---|---|---|---|
| 5,559,590 | A | 9/1996 | Arai et al. | 399/314 |
| 6,125,247 | A * | 9/2000 | Tsukida et al. | 399/66 |
| 6,173,135 | B1 * | 1/2001 | Yuminamochi et al. | 399/66 |
| 6,990,300 | B2 * | 1/2006 | Saito et al. | 399/101 |
| 7,366,438 | B2 * | 4/2008 | Takeuchi et al. | 399/101 |
| 2002/0051143 | A1 * | 5/2002 | Tsuruya | 358/1.8 |
| 2002/0154924 | A1 | 10/2002 | Takahashi et al. | 399/303 |
| 2005/0117932 | A1 * | 6/2005 | Takiguchi et al. | 399/101 |
| 2007/0127944 | A1 * | 6/2007 | Mochizuki | 399/101 |

FOREIGN PATENT DOCUMENTS

| | | |
|---|---|---|
| JP | 57-104168 | 6/1982 |
| JP | 9-304998 | 11/1997 |
| JP | 2001-265095 | 9/2001 |
| JP | 2003-91222 | 3/2003 |
| JP | 2003-323062 | 11/2003 |
| KR | 1999-51942 | 7/1999 |
| KR | 2004-70837 | 8/2004 |

OTHER PUBLICATIONS

Extended Search Report issued by the European Patent Office on Jul. 10, 2008, (EP 07 12 3582).

English language abstract for Korean Patent Publication No. 100291421, (published Mar. 12, 2001).

* cited by examiner

*Primary Examiner*—Sophia S Chen
(74) *Attorney, Agent, or Firm*—Staas & Halsey LLP

(57) ABSTRACT

An image forming apparatus includes a belt to transfer a printing medium, a plurality of support rollers which rotatably supports the belt, a photosensitive medium which has a surface on which a visible toner image is formed by charged toner, a transfer roller which is disposed adjacent to the photosensitive medium with the belt interposed therebetween, a power supplying part which supplies power to the transfer roller so that a surface of the transfer roller has an electrical potential, and a control part which controls the power supplying part to supply a pulse power, which has a middle power of a same polarity as a polarity of the charged toner, to the transfer roller so that the charged toner remaining on the belt after the belt transfers the printing medium past the photosensitive medium is transferred back to the photosensitive medium.

20 Claims, 12 Drawing Sheets

IMAGE FORMING APPARATUS HAVING REMAINING TONER REMOVING PART AND METHOD OF REMOVING REMAINING TONER THEREFROM

CROSS-REFERENCE TO RELATED APPLICATION

This application claims the benefit of Korean Application No. 2006-131204, filed Dec. 20, 2006 in the Korean Intellectual Property Office, the disclosure of which is incorporated herein by reference.

BACKGROUND OF THE INVENTION

1. Field of the Invention

Aspects of the present invention relate to an image forming apparatus having a remaining toner removing part and a method of removing remaining toner, and more particularly, to an image forming apparatus having a remaining toner removing part and a method to remove remaining toner which efficiently remove toner remaining on a belt.

2. Description of the Related Art

Generally, an image forming apparatus of an electrophotographic type forms an image on a printing medium through a series of processes. These processes include charging the printing medium and other components, exposing an electrostatic latent image on a photosensitive medium, developing the image on the photosensitive medium, transferring the image to the printing medium, and fixing the image to the printing medium. Furthermore, a variety of electrophotographic type image forming apparatuses are currently on the market including, for example, a laser printer, a scanner, a copier, a multi function device, etc.

As shown in FIG. 1, a conventional image forming apparatus 1 of an electrophotographic type includes a plurality of development cartridges 40Y, 40M, 40C, and 40K to respectively store yellow (Y) toner, magenta (M) toner, cyan (C) toner and black (K) toner, and a plurality of transfer rollers 50Y, 50M, 50C, and 50K disposed adjacent to a corresponding plurality of photosensitive media 45Y, 45M, 45C, and 45K. A printing medium transfer belt 31 is interposed between the plurality of development cartridges 40Y, 40M, 40C, and 40K and the corresponding plurality of transfer rollers 50Y, 50M, 50C, and 50K. A belt unit 30 includes the printing medium transfer belt 31 and a plurality of support rollers 32, 33, 35 and 36 which rotatably support the printing medium transfer belt 31.

Printing media P, such as sheets of paper, transparency sheets, etc., are stacked in a knock up plate 13. An individual printing medium P is picked up from the stack by a pick up roller 15 and transferred to the printing medium transfer belt 31 by a transport roller 21 to pass between the photosensitive media 45Y, 45M, 45C and 45K and the corresponding transfer rollers 50Y, 50M, 50C and 50K. When the printing medium P passes between the photosensitive media 45Y, 45M, 45C and 45K and the corresponding transfer rollers 50Y, 50M, 50C, and 50K, a yellow toner image, a magenta toner image, a cyan toner image and a black toner image are respectively transferred from the photosensitive media 45Y, 45M, 45C and 45K and overlapped onto the printing medium P by an electric attraction of each transfer roller 50Y, 50M, 50C and 50K.

When the toner is transferred to the printing medium P, some of the toner may be attached to the printing medium transfer belt 31 and remain on the printing medium transfer belt 31. To remove the remaining toner and clear the printing medium transfer belt 31, a blade 37*a* protrudes from a blade unit 37 which is connected to a frame of the image forming apparatus 1. The blade 37*a* is disposed in a position to contact the printing medium transfer belt 31 and scrape off the remaining toner.

However, in the above mechanical removing method, since the printing medium transfer belt 31 and the blade 37*a* constantly contact each other to enable the blade 37*a* to remove the remaining toner, the blade 37*a* wears down over time, deteriorating the quality of the belt cleaning.

Also, there is a conventional method of removing remaining toner from the printing medium transfer belt 31 using electricity, in which a separate toner charging device (not shown) is used to charge the toner remaining on the printing medium transfer belt 31 to have a polarity opposite to an original polarity, and thereby collect the remaining toner. However, in the conventional electric cleaning method, a separate charging device (not shown) and a control device (not shown) to control the charging device are used. Employing the separate charging device (not shown) and the control device (not shown) increases the cost of cleaning the printing medium transfer belt 31 and prevents an efficient use of space.

SUMMARY OF THE INVENTION

Accordingly, it is an aspect of the present invention to provide an image forming apparatus and a remaining toner removing method thereof to clean toner remaining on a belt efficiently and at a low cost.

According to an aspect of the present invention, an image forming apparatus includes a belt, a plurality of support rollers which rotatably supports the belt, a photosensitive medium which has a surface on which a visible toner image is formed by a charged toner, a transfer roller which is disposed adjacent to the photosensitive medium with the belt interposed therebetween, a power supplying part which supplies power to the transfer roller so that a surface of the transfer roller has an electrical potential, and a control part which controls the power supplying part to supply a pulse power which has a middle power having a same polarity as a polarity of the charged toner to the transfer roller so that the charged toner remaining on the belt is transferred back to the photosensitive medium.

According to an aspect of the invention, the charged toner is negatively charged, and the pulse power includes a pulse voltage having a maximum voltage which is equal to or less than +500V and a minimum voltage which is equal to or more than −3,000V.

According to an aspect of the invention, the image forming apparatus further includes a development cartridge which includes a cleaning blade which contacts the surface of the photosensitive medium to separate the remaining toner from the surface of the photosensitive medium, a casing which rotatably supports the photosensitive medium, and a storage part disposed inside the casing and extending from the cleaning blade, which stores the toner separated from the surface of the photosensitive medium by the cleaning blade.

According to an aspect of the invention, the transfer roller and the photosensitive medium are plural in number.

According to an aspect of the invention, the control part controls the power supplying part to supply one of the plurality of transfer rollers with a pulse power having a different amplitude from an amplitude of a pulse power supplied to another of the plurality of transfer rollers.

According to an aspect of the invention, the belt is provided to transfer a printing medium past the photosensitive media and the control part controls the power supplying part to supply the pulse power having increasing amplitudes to the respective transfer rollers along a direction in which the printing medium is transferred past the photosensitive media by the belt.

According to an aspect of the invention, at least two of the plurality of transfer rollers have electrical resistances which increase along a direction in which a printing medium is transferred past the photosensitive media by the belt, and the power supplying part supplies a pulse current to the at least two transfer rollers.

According to an aspect of the invention, the control part controls the power supplying part to supply the pulse power to at least one but less than all of the plurality of transfer rollers.

According to an aspect of the invention, the power supplying part includes a pulse power generating circuit which generates the pulse power, and a direct current power generating circuit which generates power having a polarity opposite to the polarity of the charged toner.

According to an aspect of the invention, the control part connects the pulse power generating circuit to one of the plurality of transfer rollers, and connects the direct current power generating circuit to another of the plurality of transfer rollers.

According to an aspect of the invention, the image forming apparatus further includes a power switching part which is interposed between the power supplying part and the transfer rollers to switch between the power supplied from the pulse power generating circuit and the direct current power generating circuit of the power supplying part, wherein the control part controls the power switching part to connect the direct current power generating circuit to each of the plurality of transfer rollers during printing, and to connect the pulse power generating circuit to at least one of the transfer rollers during cleaning of the remaining toner.

According to an aspect of the invention, the control part connects the pulse power generating circuit to one or more of the transfer rollers and connects the direct current power generating circuit to one or more of the transfer rollers during the cleaning of the remaining toner.

According to an aspect of the invention, the toner is positively charged, and the pulse power includes a pulse voltage having a maximum voltage which is equal to or less than +3,000V, and a minimum voltage which is equal to or greater than −500V.

According to another aspect of the present invention, there is a method of removing remaining toner from a belt which is driven by a plurality of support rollers in an image forming apparatus, the image forming apparatus including a photosensitive medium having a surface on which a visible toner image is formed by charged toner, and a transfer roller which is disposed adjacent to the photosensitive medium with the belt interposed therebetween, the method including determining whether to remove toner remaining on the belt, and if the determining indicates that the toner remaining on the belt should be removed, generating a pulse power having an average value which has a same polarity as a polarity of the toner, and supplying the pulse power to the transfer roller.

According to another aspect of the invention, the pulse power includes a pulse voltage having a maximum voltage which is equal to or less than +500V, and a minimum voltage which is equal to or greater than −3,000V.

According to another aspect of the invention, the image forming apparatus includes a plural number of the transfer roller and the photosensitive medium, and the supplying of the pulse power includes supplying the pulse power to at least one of the plurality of transfer rollers.

According to another aspect of the invention, the belt is provided to transfer a printing medium past the photosensitive media and the supplying of the pulse power further includes respectively supplying pulse powers having increasing amplitudes to each the plurality of transfer rollers in a direction in which the printing medium is transferred past the photosensitive medium by the belt.

According to another aspect of the invention, the supplying of the pulse power further includes supplying the pulse power to at least one but less than all of the plurality of transfer rollers.

According to another aspect of the invention, the p supplying of the pulse power further includes supplying power which has a polarity opposite to the polarity of the charged toner to one of the plurality of transfer rollers.

According to another aspect of the present invention, an image forming apparatus includes a belt, a photosensitive medium which has a surface on which a visible toner image is formed by charged toner, a transfer roller which is disposed adjacent to the photosensitive medium with the belt interposed therebetween, and a power supplying part which supplies electric power to the transfer roller to repel the charged toner off the belt, wherein the electric power comprises a pulse voltage with positive and negative components which are supplied according to negative and positive amounts of the charged toner remaining on the belt.

According to another aspect of the present invention, there is another method of removing toner from a belt which is driven by a plurality of support rollers and transfers a printing medium in an image forming apparatus, the image forming apparatus including a photosensitive medium having a surface on which a visible toner image is formed by charged toner and a transfer roller which is disposed adjacent to the photosensitive medium with the belt interposed therebetween, the method including supplying power to the transfer roller to repel the charged toner off the belt, wherein the power includes a pulse power with positive and negative components which are supplied according to negative and positive amounts of the charged toner remaining on the belt.

According to another aspect of the invention, the method further includes storing a determination condition which indicates whether to initiate the supplying of the power.

According to another aspect of the invention, the determination condition is based on a number of the printing media which have been printed or a length of printing time.

According to another aspect of the invention, the method further includes performing the supplying of the power when the determination condition is satisfied.

According to another aspect of the invention, the method further includes determining whether the image forming apparatus includes a plural number of the transfer roller.

According to another aspect of the invention, the method further includes if the determining of whether the image forming apparatus includes the plural number of the transfer roller indicates that the image forming apparatus does not include the plural number of the transfer roller, supplying the pulse power to the transfer roller; and if otherwise, determining whether the power supplying part is set to a general mode.

According to another aspect of the invention, the method further includes if the determining of whether the image forming apparatus is set to the general mode indicates that the power supply part is set to the general mode, supplying the pulse power to each of the plurality of transfer rollers; and if otherwise, modulating an amplitude of the pulse power.

According to another aspect of the invention, the method further includes determining whether the power supplying part is set to a power saver mode.

According to another aspect of the invention, the method further includes if the determining of whether the power supply part is set to the power saver mode indicates that the power supply part is set to the power saver mode, supplying the modulated pulse power having gradually increasing amplitudes to at least one but less than all of the transfer rollers in a direction in which the printing medium is transferred; and if otherwise, determining whether a large amount of toner having an opposite polarity of the charged toner remains on the belt.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
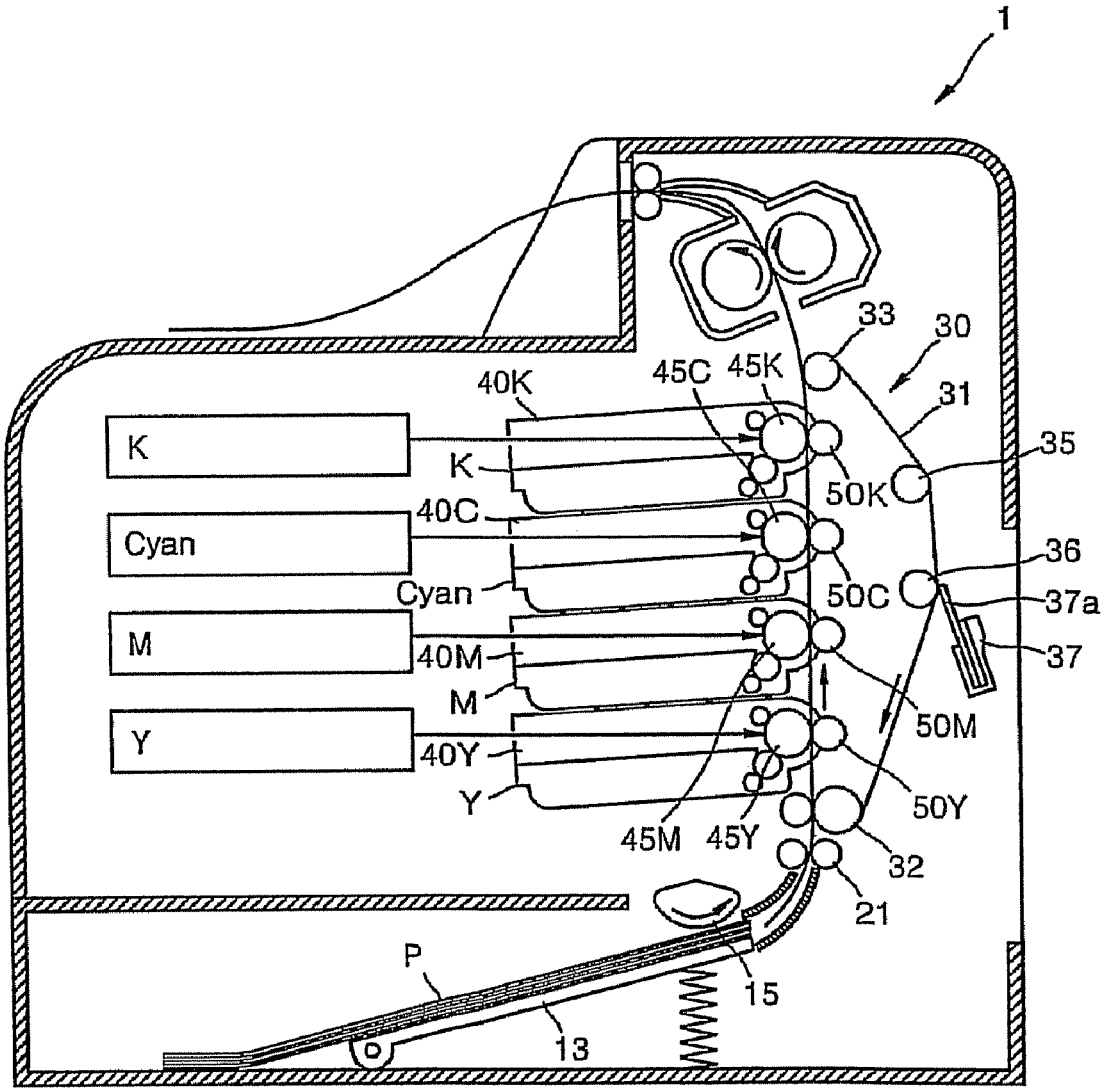
FIG. 1 (PRIOR ART)
FIG. 1 is a sectional view of a conventional image forming apparatus.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 2:
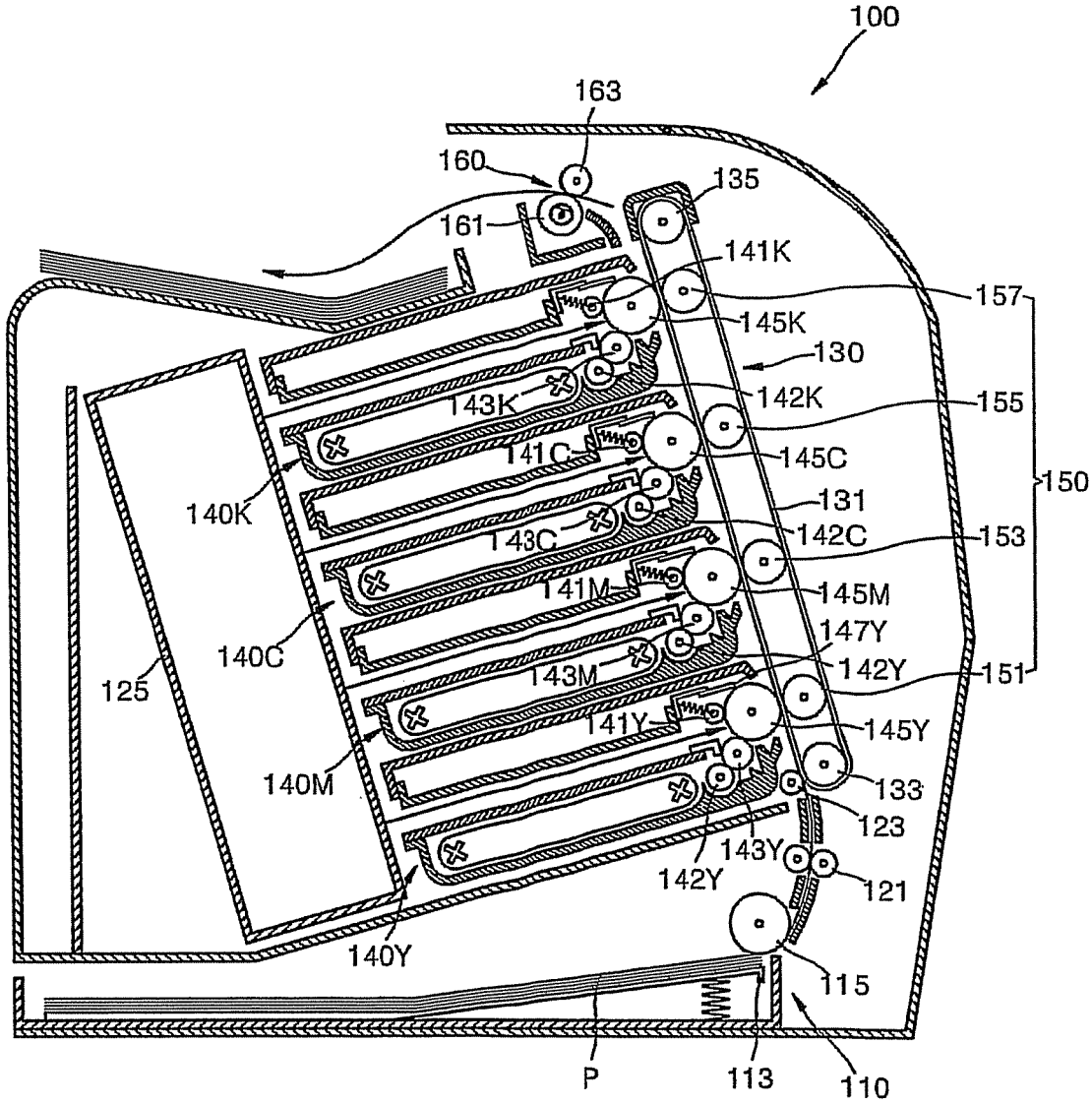
FIG. 2 is a sectional view of an image forming apparatus according to a first embodiment of the present invention.

Hereinafter, an image forming apparatus according to aspects of the present invention will be described using an electrophotographic image forming apparatus of a single path type including a plurality of photosensitive media as an example. As shown in FIG. 2, an image forming apparatus 100 according to a first embodiment of the present invention includes a feeding part 110, a belt unit 130, a plurality of development cartridges 140Y, 140M, 140C and 140K, a transfer roller unit 150 having a plurality of transfer rollers 151, 153, 155 and 157, and a fixing unit 160.

The feeding part 110 includes a knock up plate 113 and a pick up roller 115 to pick up a printing medium P, such as a sheet of paper, a transparency sheet, a sheet of recycled paper, letterhead, stationary, etc., on the knock up plate 113. The printing medium P picked up by the pick up roller 115 is transported toward the belt unit 130 by a pair of transport rollers 121.

The belt unit 130 includes a belt 131 and support rollers 133 and 135 rotatably supporting the belt 131. The belt 131 is formed out of a conductive material so that the printing medium P attaches to a surface of the belt 131 by static electricity after the printing medium P is transported to the belt 131 by the transport rollers 121. It is understood that various types of conductive materials may be used to form the belt 131, such as metallic materials.

The development cartridges 140Y, 140M, 140C and 140K respectively store yellow (Y) toner, magenta (M) toner, cyan (C) toner and black (K) toner. Each of the development cartridges 140M, 140C and 140K have the same configurations as the configuration of the yellow development cartridge 140Y except for the color of toner stored therein. Hereinafter, a configuration of the yellow development cartridge 140Y will be representatively described in order to describe the configuration of each of the four development cartridges 140Y, 140M, 140C, and 140K. It is understood, however, that aspects of the present invention are not limited to being applied to an image forming apparatus having four development cartridges, and may instead be applied to other types of image forming apparatuses, such as, for example, an image forming apparatus with three development cartridges corresponding to red, green, and blue toner.

The yellow development cartridge 140Y includes a charge roller 141Y, a supply roller 142Y, a developing roller 143Y and a photosensitive medium 145Y. The charge roller 141Y charges a surface of the photosensitive medium 145Y to a uniform electric potential (approximately −1,200V) before a light emitting unit 125 emits light to the photosensitive medium 145Y. It is understood that the charge roller 141Y may charge the surface of the photosensitive medium 145Y to more or less than approximately −1,200 V.

The supply roller 142Y supplies yellow toner stored in the development cartridge 140Y to the photosensitive medium 145Y, and friction-charges the toner so that the toner has a negative electric charge. Then, the developing roller 143Y rotates to attach the negatively charged toner to a surface of the developing roller 143Y, and develops an electrostatic latent image formed on a surface of the photosensitive medium 145Y with the toner to form a visible toner image. The electrostatic latent image is formed by a potential difference between an area exposed to light and an area which is not exposed to light when the light emitting unit 125 emits light corresponding to yellow image information to a surface of the photosensitive medium 145Y charged with a uniform electric potential. The yellow image information may be transmitted to the light emitting unit 125 from a variety of sources, such as a host computer (not shown).

Figure 3:
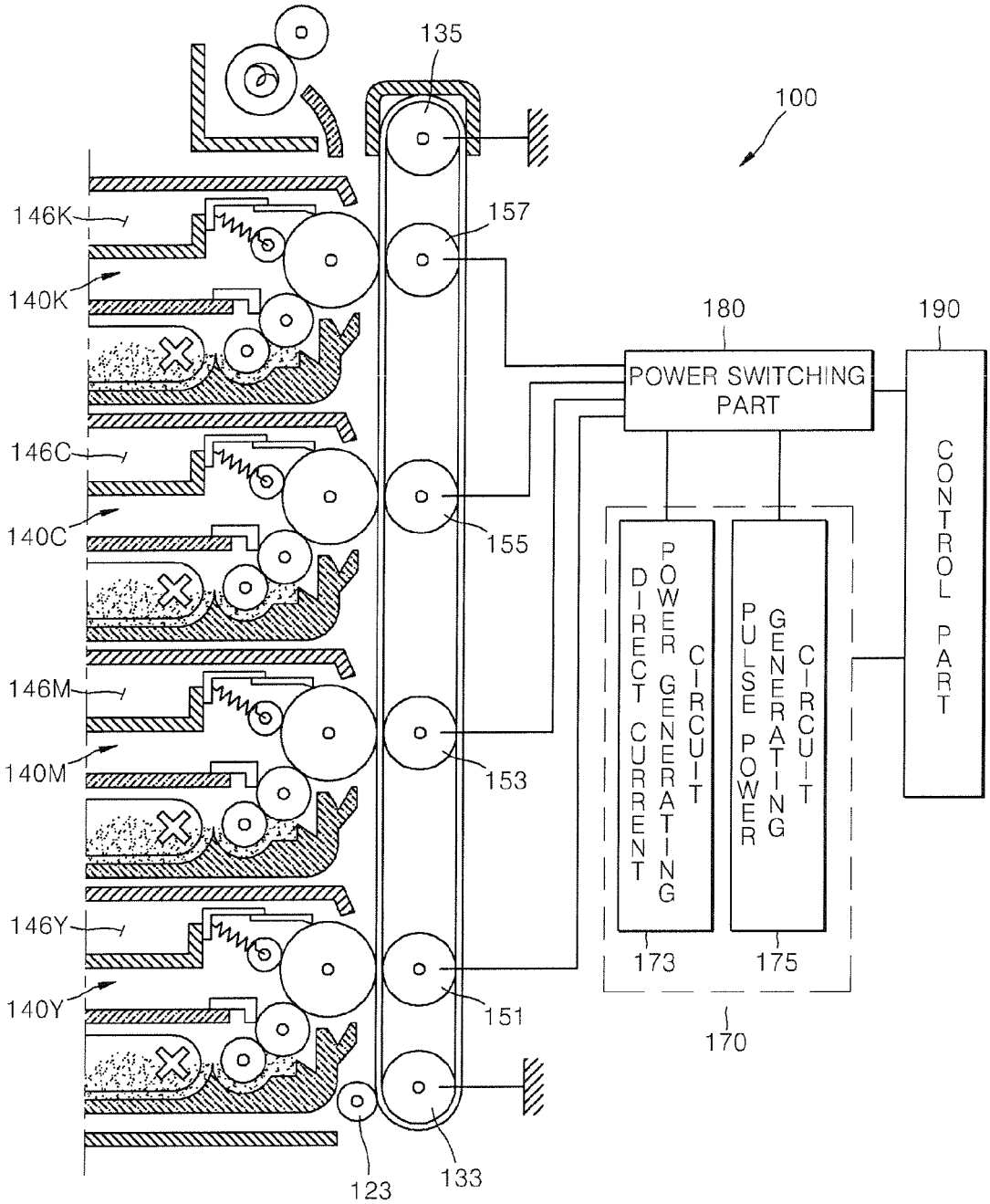
FIG. 3 is a partially enlarged sectional view of the image forming apparatus shown in FIG. 2.

The yellow development cartridge 140Y further includes a cleaning blade 147Y shown in FIG. 3 which contacts a surface of the photosensitive medium 145Y to remove toner remaining on the surface of the photosensitive medium 145Y after the photosensitive medium 145Y has applied the yellow toner to the printing medium P. The toner removed by the cleaning blade 147Y is collected in a remaining toner storage part 146Y shown in FIG. 3. The yellow development cartridge 140Y also includes a casing 144Y (FIG. 7) which rotatably supports the photosensitive medium 145Y.

Transfer rollers 151, 153, 155 and 157 are respectively disposed next to the photosensitive media 145Y, 145M, 145C and 145K of the yellow, magenta, cyan and black development cartridges 140Y, 140M, 140C and 140K, with the belt 131 interposed therebetween. The respective photosensitive media 145Y, 145M, 145C and 145K and the corresponding transfer rollers 51, 153, 155 and 157 press against each other through the belt 131 interposed therebetween.

The fixing unit 160 includes a heating roller 161 and a pressing roller 163. The heating roller 161 applies heat to the printing medium P and the pressing roller 163 presses the toner image to the printing medium P to fix the toner image to the printing medium P.

As shown in FIG. 3, the image forming apparatus 100 according to an embodiment of the present embodiment further includes a power supplying part 170, a power switching part 180 and a control part 190. The power supplying part 170 supplies a current power or a voltage power to the transfer roller 150 to charge a surface of the transfer roller 150. Hereinafter, the power supplying part 170 will be described as supplying voltage power as an example. According to an aspect, the power supplying part 170 is integrally configured with a high voltage power supply (HVPS) which supplies a high voltage to the photosensitive media 145Y, 145M, 145C, and 145K, the charging rollers 141Y, 141M, 141C, and 141K, the developing rollers 143Y, 143M, 143C, and 143K and the supply rollers 142Y, 142M, 142C, and 142K of the development cartridges 140Y, 140M, 140C and 140K. However, it is understood that the power supplying part 170 may be connected to voltage sources other than an HVPS.

As shown in FIG. 3, the power supplying part 170 includes a direct current power generating circuit 173 to generate a direct current transfer voltage having the opposite polarity of the polarity of an electric charge of the toner, and a pulse power generating circuit 175 to generate a pulse power having a middle power of the same polarity as the polarity of the electric charge of the toner. The direct current transfer voltage should generally be set to be within approximately +1,200V to +1,800V based on resistance of the printing medium P and environmental conditions, such as temperature, humidity, etc. However, it is understood that the direct current transfer voltage is not limited to being generated within the range of +1,200 V to +1,800 V, and may instead be generated within other ranges.

The pulse power generating circuit 175 overlaps a direct current power and an alternating current power to generate pulse power having a pulse shape. The pulse power has a middle power of the same polarity as the polarity of an electric charge of the toner to transfer toner remaining on the belt 131 back toward the photosensitive media 145Y, 145M, 145C and 145K by an electric repulsion.

Figure 6:
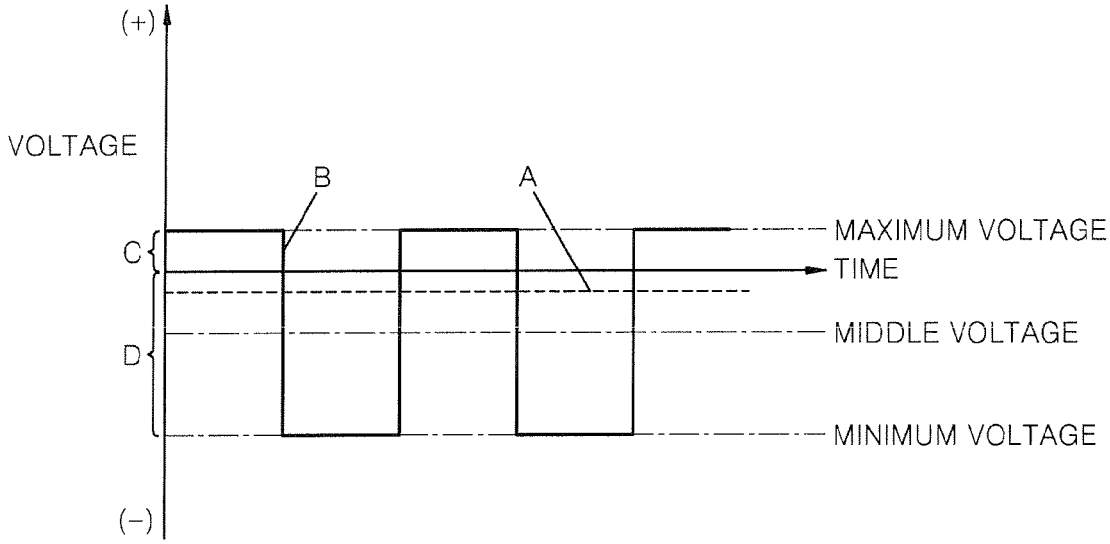
FIG. 6 illustrates a pulse voltage supplied to a transfer roller during the process of removing the remaining toner shown in FIG. 5.

According to the embodiment shown in FIG. 6, since the toner is charged with a negative charge, the pulse generating circuit 175 generates a middle, or average, voltage value which has a negative value. Also, if current instead of the voltage shown in FIG. 6 is supplied to the transfer roller unit 150, a middle current has a negative value. Furthermore, the maximum voltage of the pulse power is equal to or less than +500V, and the minimum voltage thereof is equal to or greater than −3,000V. It is understood that this range may differ according to other aspects of the present invention.

The pulse power generating circuit 175 further includes a pulse amplitude modulating circuit (not shown) to modulate the amplitude of the pulse power. The pulse amplitude modulating circuit (not shown) generates a pulse voltage, a middle voltage value of which has a negative value. Alternatively, the pulse amplitude modulating circuit (not shown) generates a pulse voltage having a uniform amplitude.

The power switching part 180 controls the direct current power generating circuit 173 to supply a direct voltage to the transfer roller 150 when a visible toner image formed on the photosensitive media 145Y, 145M, 145C and 145K is transferred to the printing medium P, in other words, when the image forming apparatus 100 is operating in a print mode. On the other hand, the power switching part 180 controls the pulse power generating circuit 175 to supply pulse power to the transfer roller 150 when toner remaining on the belt 131 is removed, in other words, when the image forming apparatus 100 is operating in a belt cleaning mode.

According to another aspect of the invention, the control part 190 performs the functions of the power switching part 180. Thus, the control part 190 controls the direct current power generating circuit 173 and the pulse power generating circuit 175 to be turned on and off according to whether the image forming apparatus 100 is operating in the print mode or the belt cleaning mode. Consequently, the power switching part 180 may be omitted. Also, according to yet another aspect of the invention, the power switching part 180 may be integrally provided with the power supplying part 170.

Figure 4:
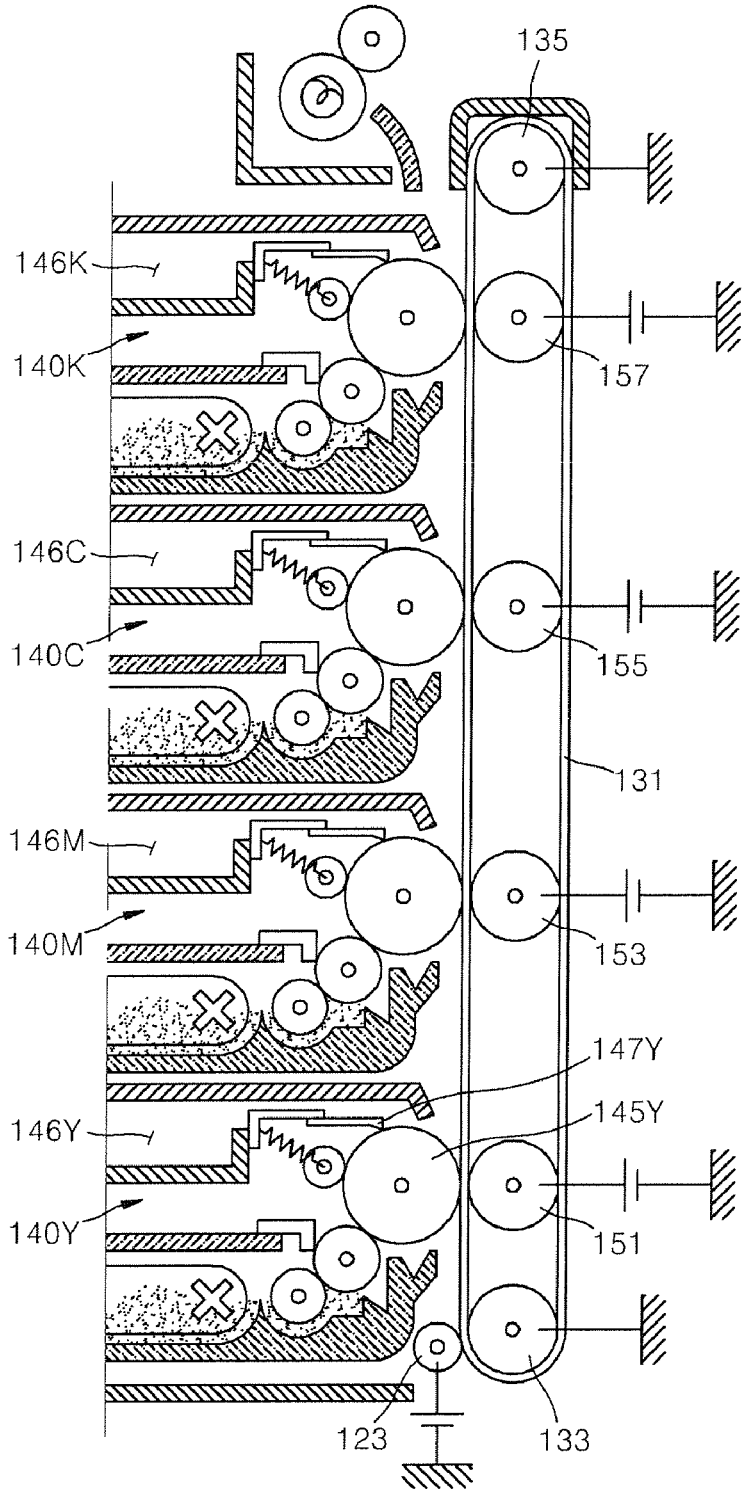
FIG. 4 is an enlarged sectional view schematically illustrating a belt unit of the image forming apparatus shown in FIG. 2 during a printing process.

Hereinafter, a color image forming process of the image forming apparatus 100 will be described by referring to FIG. 4. The power supplying part 170 shown in FIG. 3 is described as power supplying part which supplies a voltage power.

If a user is printing color images on the printing medium P, the control part 190 drives the pick up roller 115 to transport the printing medium P stacked in the knock up plate 113 to the transport roller 121, as shown in FIG. 2. The transported printing medium P contacts a printing medium charge roller 123 to which the high voltage power supply (HVPS) supplies a voltage of +500V to +1,000V. An electric resistance of the printing medium P is then measured based on the supplied voltage. The control part 190 controls the direct power generating circuit 173 of the power supplying part 170 to generate a direct current transfer voltage having a value within a range corresponding to the measured electric resistance of the printing medium P. Also, the printing medium P is attached to the transport roller 121 to pass between the photosensitive media 145Y, 145M, 145C and 145K and the belt 131. The control part 190 controls the power switching part 180 shown in FIG. 3 to supply the direct current transfer voltage generated by the direct current power generating circuit 173 to the transfer roller 150.

A surface of the photosensitive medium 145Y of the yellow development cartridge 140Y is uniformly charged to have an electric potential of −1,200V by the charge roller 141Y, and is exposed to a light emitted from the light emitting unit 125 corresponding to yellow image information so that an electrostatic latent image can be formed on the surface of the photosensitive medium 145Y. Negatively charged yellow toner is applied to the electrostatic latent image on the surface of the photosensitive medium 145Y by an electric force with the developing roller 143Y. Accordingly, a yellow visible toner image is formed on the surface of the photosensitive body 145Y.

The negatively charged visible yellow toner image is transferred to the printing medium P passing between the belt 131 and the photosensitive medium 145Y by an electric attraction between the negatively charged yellow toner and the positively charged first transfer roller 151.

Next, when the printing medium P passes through the development cartridges 140M, 140C, and 140K which respectively store magenta, cyan and black toner, magenta, cyan and black visible toner images are formed on the printing medium P in an overlapping fashion through the same process described above with reference to the development cartridge 140Y. Accordingly, a complete color image is formed on the printing medium P. Then, the printing medium P having the color image applied thereon passes through the fixing unit 160 which fixes the color image to the printing medium P using heat and pressure respectively supplied from the heating roller 161 and the pressing roller 163. Then, the printing medium P is discharged to the outside of the image forming apparatus 100.

Figure 5:
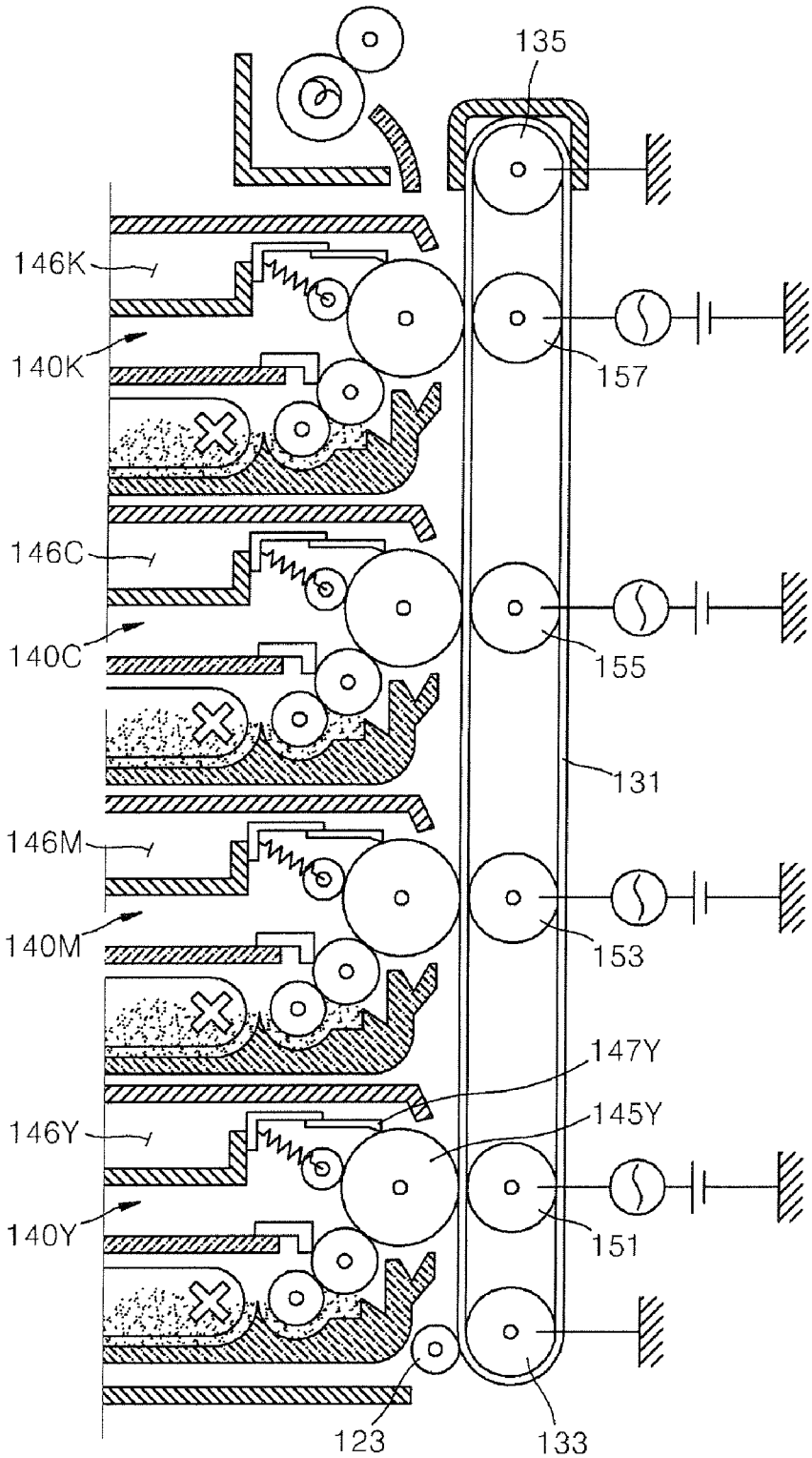
FIG. 5 is a partially enlarged sectional view illustrating the belt unit of the image forming apparatus shown in FIG. 2 during a process of removing remaining toner.

Hereinafter, a process of removing toner remaining on the belt 131 of the image forming apparatus 100 according to an embodiment will be described by referring to FIGS. 5 and 7.

To remove toner remaining on the belt 131, the control part 190 controls the power switching part 180 to supply a pulse voltage generated by the pulse power generating circuit 175 to all of the transfer rollers 511, 153, 155 and 157. Electric charges of the photosensitive media 145Y, 145M, 145C and 145K are removed so that a surface potential of each of the photosensitive media 145Y, 145M, 145C and 145K is approximately −50V to 0V.

As shown in FIG. 6, the control part 190 controls the pulse power generating circuit 175 to generate a pulse voltage B, a middle voltage value of which is smaller than a surface potential A of each of the photosensitive media 145Y, 145M, 145C and 145K. Also, the control part 190 rotates the support rollers 133 and 135 to circulate the belt 131 while the pulse voltage B is supplied.

Figure 7:
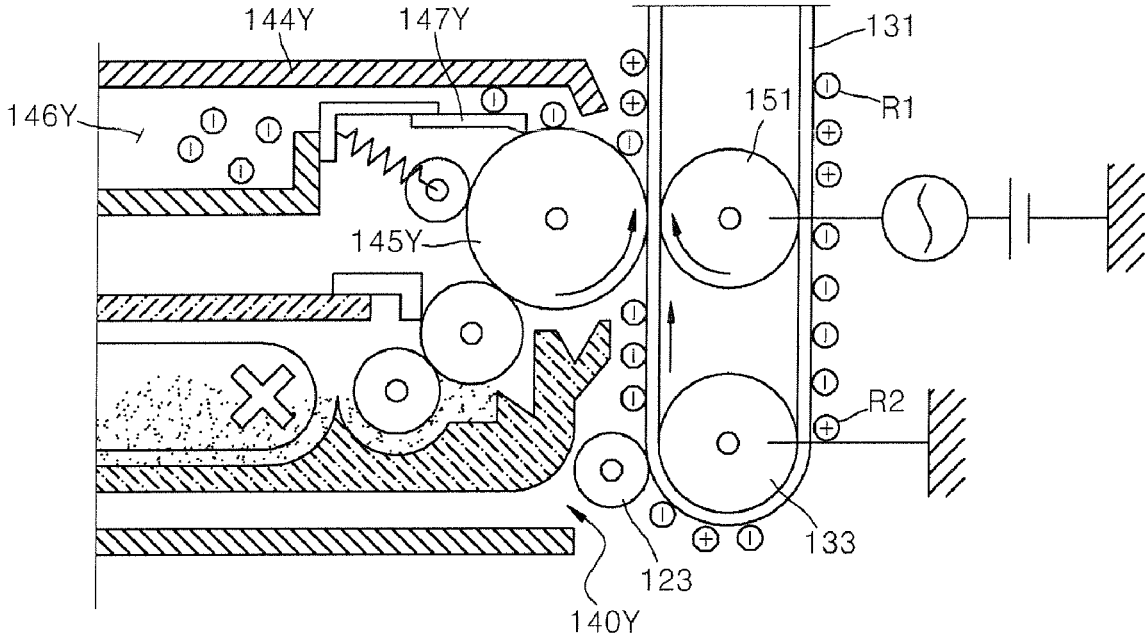
FIG. 7 illustrates a first transfer roller of the belt unit shown in FIG. 2 during the process of removing the remaining toner.

FIG. 7 is an enlarged view illustrating the first transfer roller 151 of the belt unit 130 shown in FIG. 2 during the process of removing remaining toners R1 and R2 on the belt 131. As shown in FIG. 7, the remaining toners R1 and R2 are transferred back to the photosensitive media 145Y by the pulse voltage supplied to the first transfer roller 151 shown in FIG. 5. Generally, negatively charged toner R1 remains on the belt 131 after the image forming process. Additionally, positively charged toner R2 may on occasion remain on the belt 131.

When the pulse voltage is supplied to the first transfer roller 151, the negatively charged toner R1 on the belt 131 reciprocates between the belt 131 and the photosensitive medium 145Y according to a frequency and an electric force of the pulse voltage. Part of the toner moves to the photosensitive medium 145Y, and another part of the toner remains on the belt 131.

Specifically, when component C of the pulse voltage shown in FIG. 6 is supplied to the first transfer roller 151, the negatively charged toner R1 becomes electrically attracted towards the belt 131. When component D of the pulse voltage is supplied to the first transfer roller 151, the negatively charged toner R1 becomes electrically repulsed toward the photosensitive medium 145Y. Since the absolute value of the component D is greater than the absolute value of the component C, the electric repulsion is greater than the electric attraction so that the amount of toner transferred back toward the photosensitive medium 145Y is relatively large compared to the amount of toner attracted to the belt 131. In other words, the pulse power has positive and negative components which are supplied according to negative and positive amounts of the charged toner remaining on the belt 131. Here, since a surface potential of the photosensitive medium 145Y is greater than the component D of the pulse voltage which is supplied to the transfer roller 151, an electric repulsion between the photosensitive medium 145Y and the negatively charged toner R1 is negligible.

Although the negatively charged toner R1 is electrically attracted to the belt 131 to be attached thereto, the attaching force becomes significantly weakened over time. Therefore, the negatively charged toner R1 is easily transferred back to the photosensitive medium 145M of the magenta development cartridge 140M by a second transfer roller 153. The negatively charged toner R1 transferred back to the photosensitive medium 145Y is scraped off by the cleaning blade 147Y and collected into the remaining toner storage part 146Y.

Meanwhile, the positively charged toner R2 receives an electric repulsion by the component C of the pulse voltage shown in FIG. 6 which repels the positively charged toner R2 back towards the photosensitive medium 145Y. However, since the absolute value of the component D is greater than the absolute value of the component C, an amount of the positively charged toner R2 repelled towards the photosensitive medium 145Y by the component C is less than an amount of the negatively charged toner R1 repelled towards the photosensitive medium 145Y by the component D.

The following Table 1 discloses an experimental result indicating the number of belt rotations to completely remove toner remaining on the belt 131 in the case that a direct current reverse transfer voltage having the same polarity as the charged toner is applied to the transfer roller unit 150, and in the case that the pulse voltage is supplied to the transfer unit 150, to transfer the toner remaining on the belt 131 back to the photosensitive media 145Y, 145M, 145C, and 145K. In the experiment, the types of voltages were changed, while all the other conditions except the applied voltage remained constant.

TABLE 1

| direct current reverse transfer voltage (V) | belt rotation number | pulse voltage (V) | belt rotation number |
|---|---|---|---|
| −500 | 9 | Middle voltage −500, amplitude 500 | 6 |
| −1,000 | 7 | Middle voltage −1,000, amplitude 1,000 | 5 |
| −1,500 | 5 | Middle voltage −1,500, amplitude 1,500 | 4 |
| −2,000 | 4 | Middle voltage −2,000, amplitude 2,000 | 2 |
| −2,500 | 3 | Middle voltage −2,500, amplitude 2,500 | 2 |
| −3,000 | 2 | Middle voltage −3,000, amplitude 3,000 | 1 |

The belt rotation number, which represents the number of cycles the belt 131 rotates, and an amount of time in which the remaining toner is cleaned from the belt 131, are in proportion to each other. Accordingly, as shown in Table 1, an amount of time needed to remove toner remaining on the belt 131 is smaller when the pulse voltage is supplied to the transfer roller unit 150 compared to when the direct current reverse transfer voltage is supplied to the transfer roller unit 150. For example, when a direct current reverse transfer voltage of −500V is supplied to the transfer roller unit 150, the belt 131 rotates nine times before the toner remaining on the belt 131 is fully cleaned off. In contrast, when the power supplying part 170 supplies a pulse voltage having a middle voltage of −500V and an amplitude of 500V, in other words, supplies a pulse voltage having a maximum voltage of 0V and a minimum voltage of −1,000V, the power supplying part 170 reduces the number of times that the belt 131 rotates to 6 rotations, thereby reducing the cleaning time by approximately 33%.

Also, as voltage supplied to the transfer roller unit 150 is increased, the cleaning time accordingly decreases. However, as the supplied voltage becomes higher, more power is consumed by the transfer roller unit 150. Accordingly, users should consider power consumption limits when determining how much voltage to supply to the transfer roller unit 150.

Figure 8:
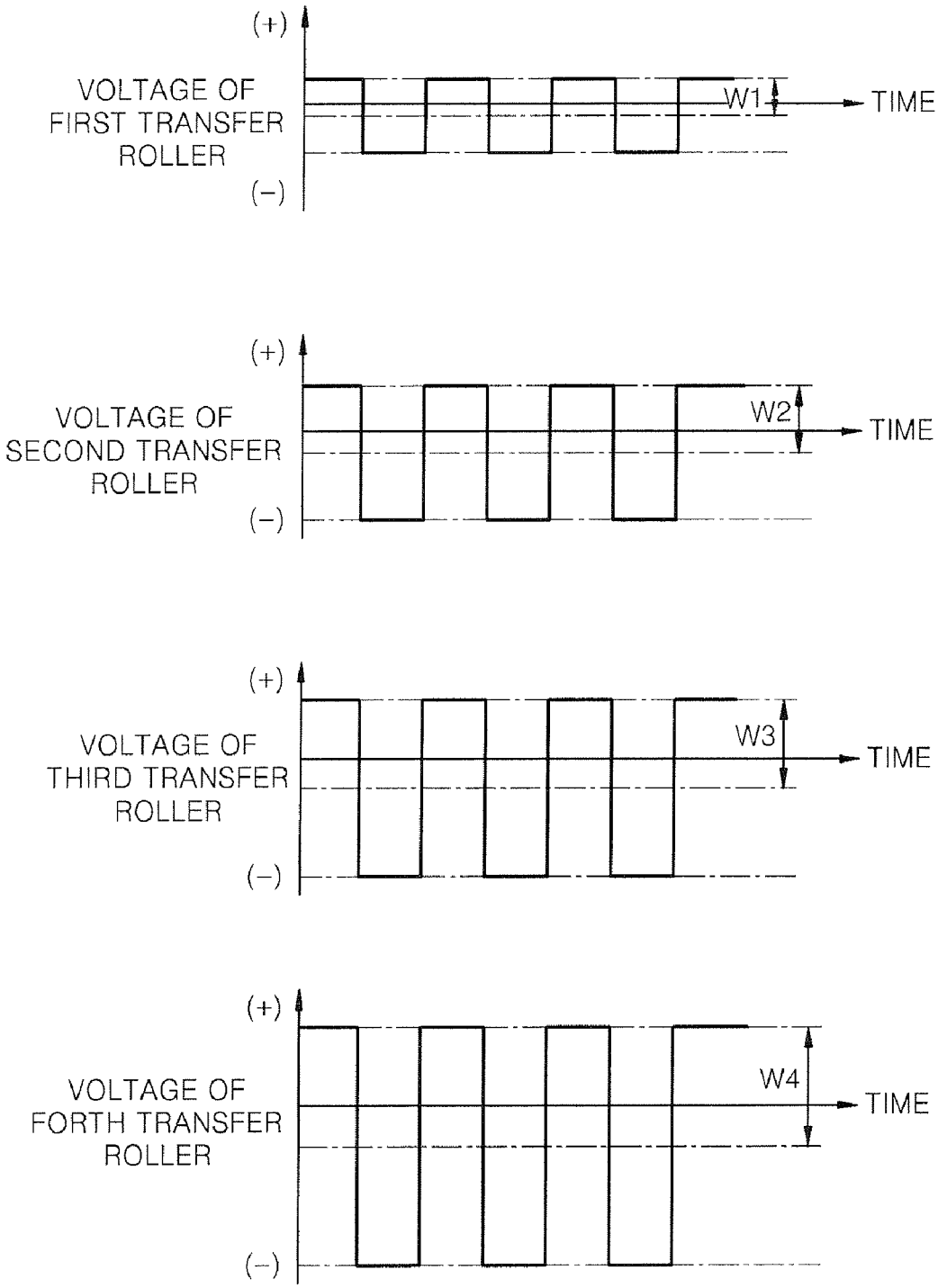
FIG. 8 illustrates pulse voltages respectively supplied to a plurality of transfer rollers of an image forming apparatus according to a second embodiment of the present invention.

An image forming apparatus (not shown) according to a second embodiment of the present invention supplies a pulse voltage shown in FIG. 8 to the transfer roller unit 150 shown in FIG. 2 similar to the manner in which the image forming apparatus 100 of the first embodiment supplies the pulse voltage shown in FIG. 6 to the transfer roller unit 150 to remove toner remaining on the belt 131. However, in contrast to the image forming apparatus 100 of the first embodiment, the image forming apparatus (not shown) according to a second embodiment further includes a pulse amplitude modulating control part (not shown) to modulate and transmit pulses with different pulse amplitudes to each transfer roller 151, 153, 155, and 157.

The pulse amplitude modulating control part (not shown) controls the pulse power generating circuit 175 to generate four pulse powers having different amplitudes from each other according to the equation W1<W2<W3<W4. The pulse amplitude modulating control part (not shown) supplies a pulse power having the smallest amplitude W1 to the first transfer roller 151 shown in FIG. 2, and respectively supplies pulse powers having increasing amplitudes W2, W3, and W4 to a second transfer roller 153, a third transfer roller 155, and a fourth transfer roller. Thus, the plurality of transfer rollers 151, 153, 155, and 157 within the transfer roller unit 150 shown in FIG. 2 are respectively supplied with the pulse powers W1, W2, W3, and W4 having amplitudes which increase along a direction in which the printing medium P moves past the plurality of photosensitive media 145Y, 145M, 145C, and 145K while being transferred by the belt 131.

Accordingly, the pulse power having the smallest amplitude W1 is supplied to the first transfer roller 151 to transfer the toner remaining on the belt 131 back to the photosensitive medium 145Y at a point when the most toner is attached to the belt 131. Also, the pulse power W4 having the largest amplitude is supplied to the fourth transfer roller 157 to transfer back toner which remains on the belt 131 due to a relatively strong attractive force after the majority of the toner remaining on the belt 131 has been removed. Accordingly, by gradually increasing the amplitudes W1, W2, W3, and W4, the efficiency of the belt cleaning operation is improved.

Also, since the amount of the toner remaining on the belt 131 which is transferred back to each photosensitive medium 145Y, 145M, 145C and 145K by the gradually increasing amplitudes W1, W2, W3, and W4 is substantially similar, the remaining toner storage parts 146Y, 146M, 146C and 146K may be designed to be relatively small and to have the same shapes. If a pulse voltage of a uniform amplitude is supplied to each of the transfer rollers 150Y 150M, 150C, and 150K of the transfer roller unit 150, the amount of toner remaining on the belt 131 which is transferred back to each photosensitive medium 145Y, 145M, 145C and 145K is largest in the photosensitive medium 145Y of a yellow development cartridge 140Y, and the amount of toner transferred back to the photosensitive media 145M, 145C, and 145K gradually decreases. Accordingly, the sizes of the remaining toner storage parts 146Y, 146M, 146C, and 146K of the respective development cartridges 140Y, 140M, 140C, and 140K should be gradually reduced. However, by applying the gradually increasing amplitudes W1, W2, W3, and W4, the other remaining toner storage parts 146M, 146C and 146K may be designed to be substantially similar in size and shape, thereby making a more efficient use of space.

That is, since the toner remaining on the belt 131 which is not transferred back while passing through the first, second, and third transfer rollers 151, 153, and 155, respectively, has a relatively large attaching force compared to the toner which is transferred back to one of the first, second, and third transfer rollers 151, 153 and 155, a reverse transfer efficiency is improved by enlarging the amplitude of the pulse power W4 supplied to the fourth transfer roller 157 in comparison to supplying the pulse power of a uniform amplitude to all of the first, second, third, and fourth transfer rollers 151, 153, 155, and 157. Accordingly, it is unnecessary to supply excess power, thereby reducing power consumption and maintenance costs.

The first, second, third, and fourth transfer rollers 151, 153, 155, and 157 used in the image forming apparatuses of the first and the second embodiments are formed of the same materials, and have the same electric resistances. However, according to another aspect of the present invention, if a pulse current power having a uniform amplitude is supplied to the transfer rollers 151, 153, 155, and 157, the four transfer rollers 151, 153, 155, and 157 may be designed to have different electrical resistances. Specifically, the electrical resistance of the transfer rollers 151, 153, 155, and 157 may be increased from a small electrical resistance to a large electrical resistance in the first, second, third, and fourth transfer rollers 151, 153, 155, and 157 in sequence, thereby obtaining the same effect as supplying the pulse voltage shown in FIG. 8.

Figure 9:
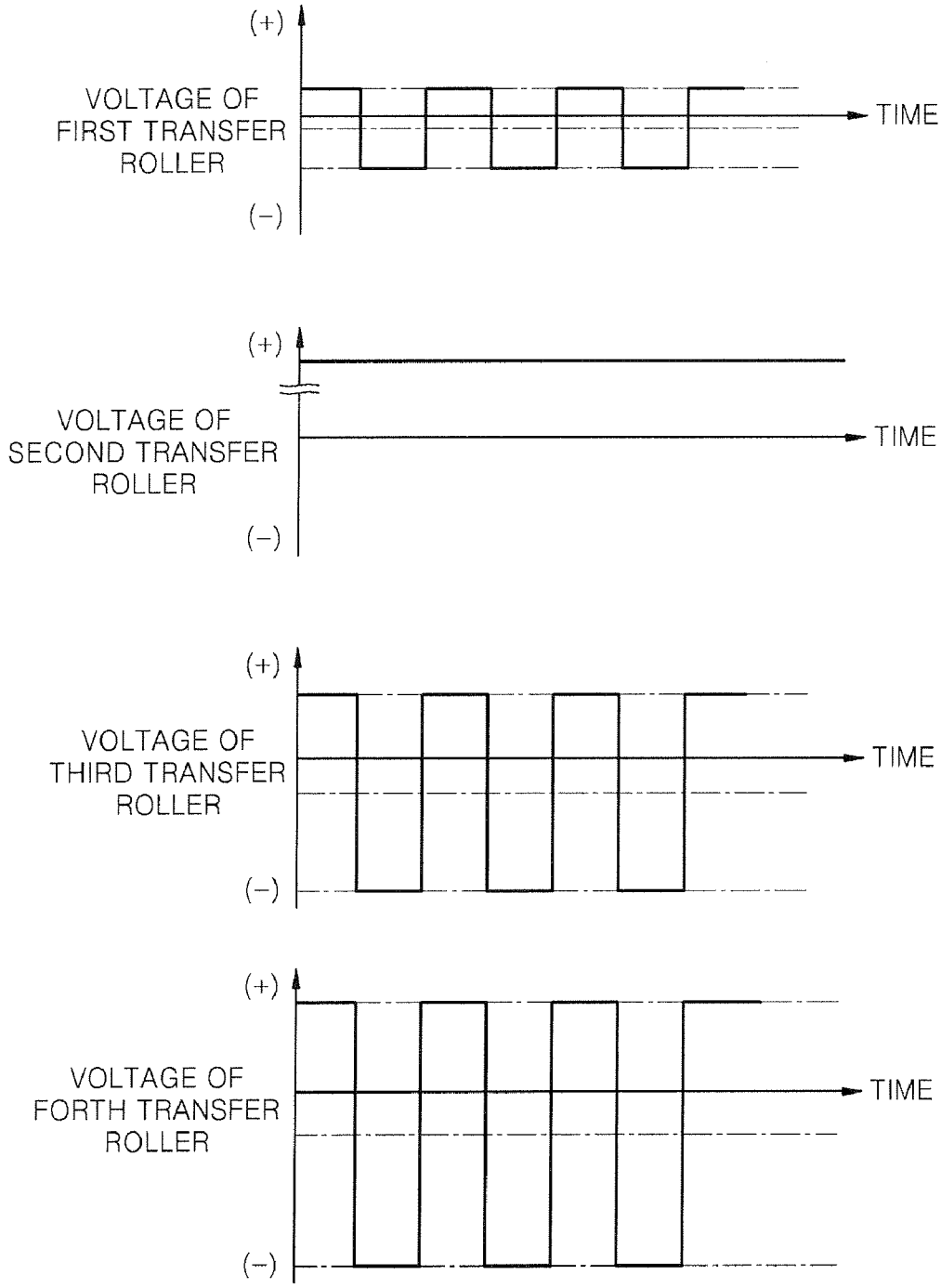
FIG. 9 illustrates pulse voltages respectively supplied to a plurality of transfer rollers of an image forming apparatus according to a third embodiment of the present invention.

An image forming apparatus (not shown) according to a third embodiment of the present invention supplies voltage as shown in FIG. 9 to the first, second, third, and fourth transfer rollers 151, 153, 155 and 157, respectively. In an image forming apparatus (not shown) according to a third embodiment of the present invention, the control part 190 shown in FIG. 3 supplies the direct current transfer voltage described in the first embodiment to one of the first, second, third and fourth transfer rollers 151, 153, 155 and 157, and supplies pulse voltage to the remaining number. In FIG. 9, the direct current transfer voltage is supplied to the second transfer roller 153. Alternatively, the control part 190 can supply the direct current transfer voltage to one of the first, third, or fourth transfer rollers 151, 155 or 157.

Figure 10:
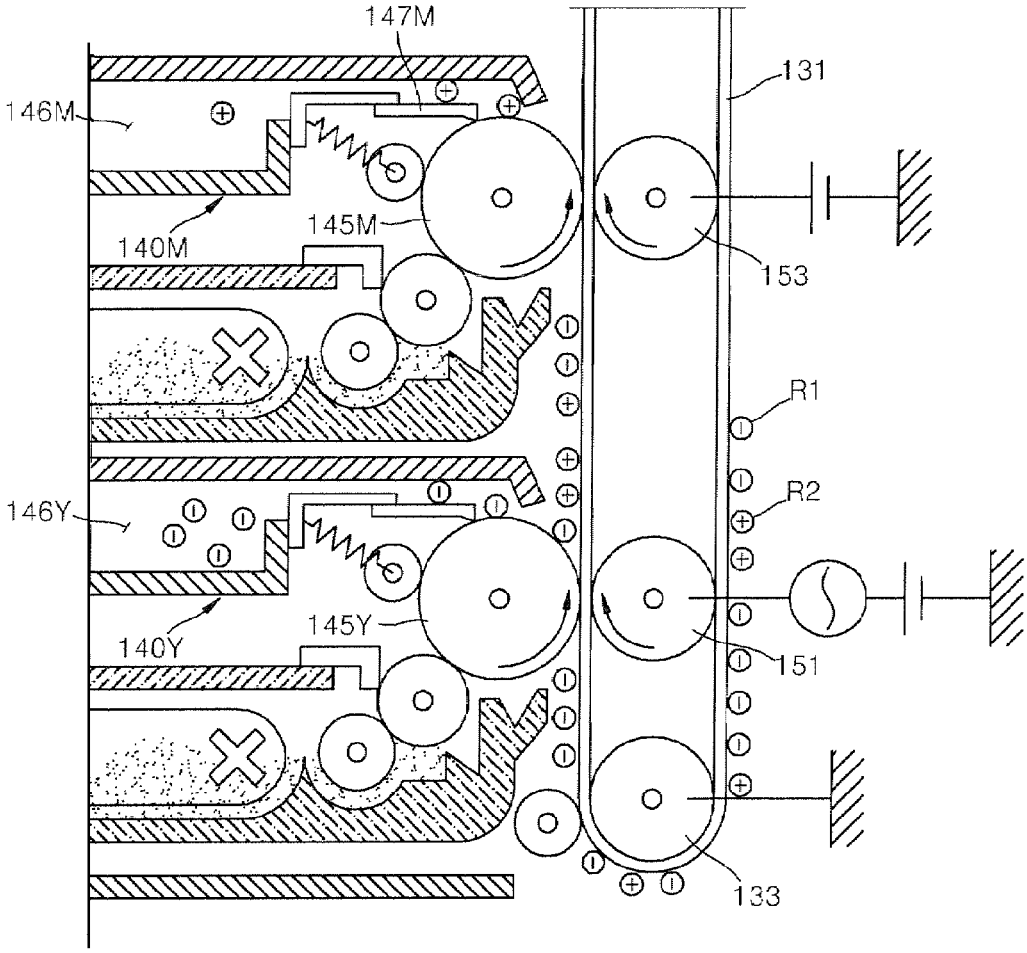
FIG. 10 illustrates a process of removing toner remaining on a belt of the image forming apparatus shown in FIG. 9.

As shown in FIG. 10, positively charged toner R2 remaining on a belt 131 with a strong attractive force is transferred back to the photosensitive medium 145M of the magenta development cartridge 140M by the second transfer roller 153. The positively charged toner R2 is then scraped off the photosensitive medium 145M by a cleaning blade 147M and collected in a remaining toner storage part 146M. Accordingly, the positively charged toner R2 which is attached to the belt 131 with a strong attractive force is easily removed from the belt 131

According to another aspect, a positive pulse power having polarity opposite to the polarity of the toner, in other words, a pulse having a middle voltage or a middle current with a positive polarity, may be used instead of the direct current transfer voltage applied to the second transfer roller, as shown in FIG. 9. Also, if a positive pulse voltage is supplied to the second transfer roller 153, the positive pulse voltage may be symmetrical with respect to a time axis, such as, for example, the pulse voltage shown in FIG. 6.

Figure 11:
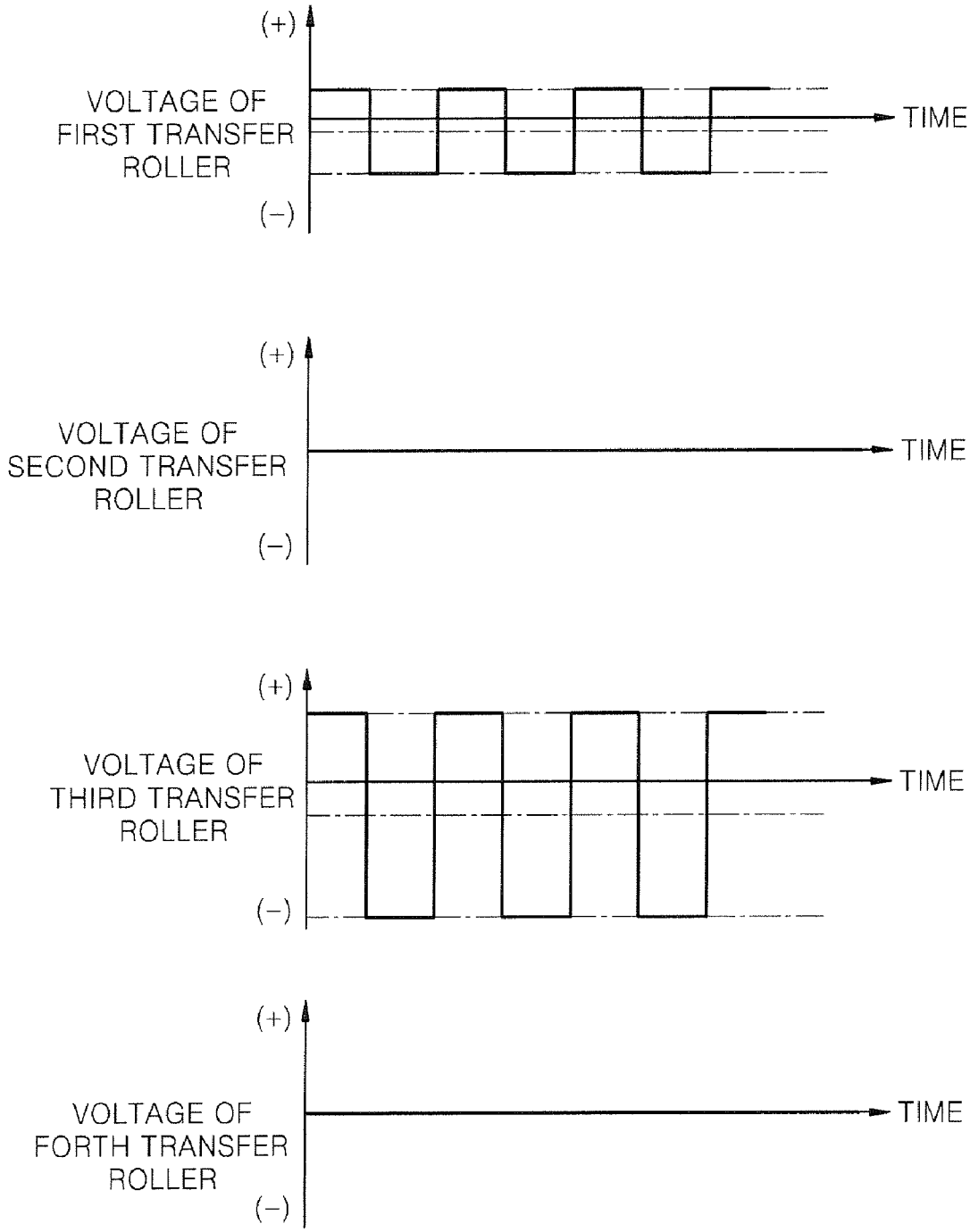
FIG. 11 illustrates pulse voltages respectively supplied to a plurality of transfer rollers of an image forming apparatus according to a fourth embodiment of the present invention.

An image forming apparatus (not shown) according to a fourth embodiment of the present invention supplies voltage as shown in FIG. 11 to at least one but less than all of the first, second, third, and fourth transfer rollers 151, 153, 155 and 157 to remove toner remaining toner on the belt 131 shown in FIG. 2. In the image forming apparatus according to the second embodiment, the respective transfer rollers 151, 153, 155 and 157 shown in FIG. 2 are each supplied with a pulse voltage having different amplitudes from each other. However, in the fourth embodiment of the present invention, only the first transfer roller 151 and the third transfer roller 155 are supplied with pulse voltages having different amplitudes.

Accordingly, during the operation to remove the toner remaining on the belt 131, only two of the transfer rollers 151 and 155 are supplied with the pulse voltage, thereby reducing power consumption and maintenance costs. It is understood that the pulse voltages are not limited to being applied to the first and third transfer rollers 151 and 155, and may instead be applied to any two rollers, such as the second and fourth transfer rollers 153 and 157.

Figure 12:
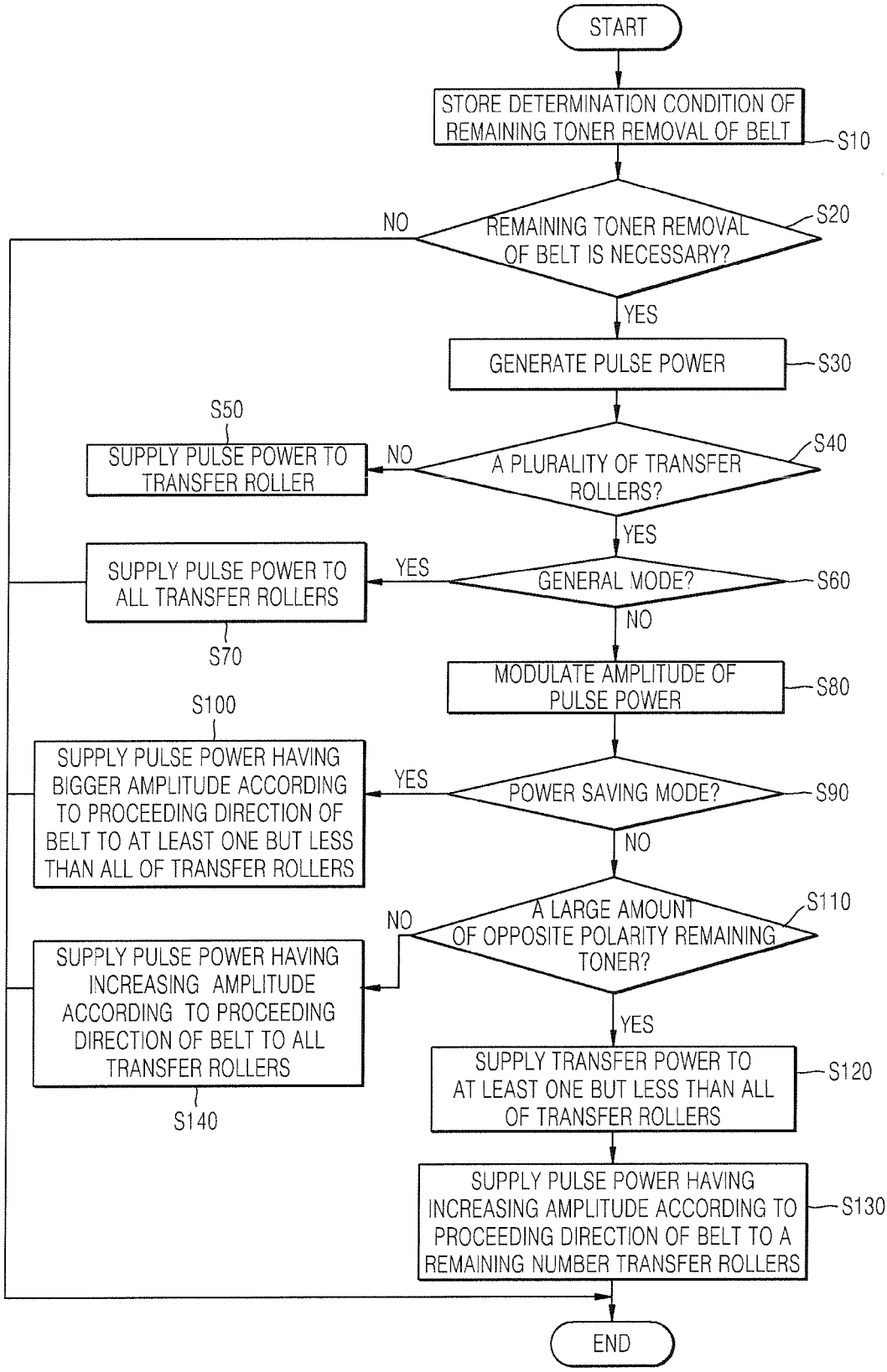
FIG. 12 is a flowchart of a method of removing toner remaining on a belt according to an embodiment of the present invention.

Hereinafter, a remaining toner removing method of an image forming apparatus 100 according to an embodiment of the present invention will be described by referring to FIG. 12.

At operation S10, a determination condition is stored in a storage medium in communication with the image forming apparatus 100. The determination condition determines when to remove the toner remaining on the belt 131 based on any number of factors, including, for example, when a predetermined number of printing media have been printed or when a predetermined length of printing time has elapsed. The determination condition may further determine a period of time in which the toner remaining on the belt 131 is removed. In operation S20, it is determined whether the remaining toner should be removed based on the stored determination condition. For example, when the determination condition is based on whether a predetermined number of printing media have been printed or whether a predetermined length of printing time has elapsed, by detecting that the number of printing media have been printed, or that the predetermined length of time has elapsed, it can be determined whether the remaining toner should be removed.

Also, the determination condition may be set so that the toner remaining on the belt 131 is removed directly after a printing operation is finished. Furthermore, according to another aspect, a user may manually enter a command to remove the toner remaining on the belt 131, in which case no determination condition is necessary, and operation S10 may be omitted.

Then, at operation S30, the power supplying part 170 generates a pulse power having a middle power with the same polarity as the polarity of the charged toner. Then, in operation S40, it is determined whether the transfer roller unit 150 includes a plurality of transfer rollers. If it is determined in operation S40 that the transfer roller unit 150 does not include a plurality of transfer rollers, the power supplying part 170 supplies pulse power to the single transfer roller in operation S50. If it is determined in operation S40 that the transfer roller unit 150 includes a plurality of transfer rollers, such as, for example, the first, second, third, and fourth transfer rollers 151, 153, 155, and 157 (FIG. 2), it is determined in operation S60 whether the power supplying part 170 is set to a normal mode. If it is determined in operation S60 that the power supplying part 170 is set to the normal mode, the power supplying part 170 supplies the pulse power to each of the plurality of transfer rollers in the transfer roller unit 150 at operation S70.

If it determined in operation S60 that the power supplying part 170 is not set to the normal mode, in other words, if it is determined that the power supplying part 170 is set to a reverse transfer high efficiency mode, the pulse amplitude modulating circuit (not shown) modulates the amplitude of the pulse power at operation S80. Then, it is determined whether the power supplying part 170 is set to a power saving mode at operation S90.

If it is determined in operation S90 that the power supplying part 170 is set to the power saving mode, the power supplying part 170 transmits pulse powers having gradually increasing amplitudes to at least one but less than all of the transfer rollers in the transfer roller unit 150, such as, for example, the first and third transfer rollers 151 and 155, in a transferring direction at operation S100. The transferring direction of the belt 131 refers to a direction in which the printing medium P moves past the photosensitive media 145Y, 145M, 145C and 145K while being transferred by the belt 131. For example, voltage as shown in FIG. 11 may be respectively supplied to the first, second, third, and fourth transfer rollers 151, 153, 155 and 157.

If it is determined in operation S90 that the power supplying part 170 is not set to the power saving mode, it is then determined in operation S110 whether a large amount of toner having a polarity opposite to the original polarity of the charged toner remains on the belt 131. This determination may be automatically performed using a toner polarity sensor (not shown). Alternatively, a user may manually enter a command indicating that the belt 131 contains a large amount of toner having an opposite polarity. Furthermore, a user may set a default mode permanently indicating that a large amount of toner has opposite polarity.

As shown in FIG. 2, since toner stored in the development cartridge 140Y is friction-charged to a negative charge by the supply roller 142Y, the toner with opposite polarity refers to toner remaining on the belt 131 which is positively charged. It is understood, however, that if the toner is friction-charged to a positive charge, the toner with opposite polarity refers to toner remaining on the belt 131 having a negative charge.

If it is determined in operation S110 that a large amount of toner having an opposite polarity remains on the belt 131, the power supplying part 170 supplies at least one but less than all of the transfer rollers in the transfer roller unit 150, such as, for example, the second transfer roller 153, with direct current power in operation S120. Here, direct current power refers to a direct current voltage power or a direct current power having a polarity opposite to the original polarity of the charged toner. Also, at operation S130, the power supplying part 170 supplies a remaining number of the transfer rollers, such as, for example, the first, third, and fourth transfer rollers 151, 155, and 157, respectively, with pulse powers having amplitudes which respectively increase in magnitude along a proceeding direction of the belt. For example, voltages including a direct current transfer voltage and pulse power, such as the voltages shown in FIG. 9, are supplied to the first, second, third, and fourth transfer rollers 151, 153, 155 and 157, respectively. As shown in FIG. 9, the amplitude of the transfer voltages supplied to the first, third, and fourth transfer rollers 151, 155 and 157 increase in magnitude from the first transfer roller 151 to the fourth transfer roller 157.

If it is determined in operation S110 that there is not a large amount of toner having an opposite polarity remaining on the belt 131, the power supplying part 170 supplies each of the transfer rollers 151, 153, 155, and 157 with pulse powers having amplitudes which respectively increase along a direction in which the printing medium P is transferred by the belt 131 at operation S140.

Accordingly, aspects of the present invention enable the remaining toner on the belt 131 to be removed without adding many additional devices, thereby saving space and reducing manufacturing costs.

Also, aspects of the present invention improve durability in comparison with the mechanical method of removing toner remaining on the belt 131 with the blade 37*a* shown in FIG. 1.

Furthermore, by supplying pulse power to the transfer roller to intensify movement of the remaining toner on the belt 131, an attaching force of the remaining toner is weakened in a short period of time. Accordingly, the remaining toner is easily removed from the belt 131.

The belt 131 is exemplarily described above as a printing medium transfer belt to statically attach and transport a printing medium P through the image forming apparatus 100, but aspects of the present invention are not limited thereto. Alternatively, aspects of the present invention may be applied to a transfer belt type in which a visible toner image formed on a photosensitive medium is transferred to the surface of the transfer belt, and the visible toner image on the transfer belt is then transferred to the printing medium P. Additionally, it is understood that aspects of the present invention may be used with other types of belts and apparatuses as well.

As described above, an image forming apparatus having a remaining toner removing part and a method of removing remaining toner according to aspects of the present invention remove toner remaining on a belt 131 without adding many separate devices.

Furthermore, an image forming apparatus having a remaining toner removing part and a method of removing remaining toner according to aspects of the present invention save space and reduce manufacturing costs.

Also, an image forming apparatus having a remaining toner removing part and a method of removing remaining toner according to aspects of the present invention have improved durability in comparison with a mechanical remaining toner removing part and method of mechanically removing remaining toner, and continuously maintain efficient removal of the remaining toner despite being used for a long period of time. Accordingly, cleaning deterioration due to a long period of use is prevented.

Also, an image forming apparatus having a remaining toner removing part and a method of removing remaining toner according to aspects of the present invention weaken an attaching force of toner attached to the belt 131 by supplying a pulse power to a transfer roller unit 150 in a short period of time. Accordingly, the toner remaining on the belt 131 is removed more rapidly.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus, comprising:

a belt;

a plurality of support rollers which rotatably supports the belt;

a plurality of photosensitive media, each having a surface on which a visible toner image is formed by charged toner;

a plurality of transfer rollers disposed adjacent to the photosensitive media with the belt interposed therebetween;

a power supplying part which supplies power to at least two of the plurality of transfer rollers so that a surface of the at least two of the plurality of transfer rollers have an electrical potential; and a control part which controls the power supplying part to supply a pulse power which has a middle power level having a same polarity as a polarity of the charged toner to the at least two of the plurality of transfer rollers so that the charged toner remaining on the belt is transferred back to at least one of the plurality of photosensitive media;

wherein the at least two of the plurality of transfer rollers have electrical resistances which increase along a direction in which a printing medium is transferred past the photosensitive media by the belt.

2. The image forming apparatus according to claim 1, further comprising a development cartridge which comprises:

a cleaning blade which contacts the surface of at least one of the plurality of photosensitive media to separate the remaining toner from the surface of the at least one of the plurality of photosensitive media;

a casing which rotatably supports the plurality of photosensitive media; and a storage part disposed inside the casing and extending from the cleaning blade, which stores the toner separated from the surface of the at least one of the plurality of photosensitive media by the cleaning blade.

3. The image forming apparatus according to claim 1, wherein the control part controls the power supplying part to supply the pulse power to at least one but less than all of the plurality of transfer rollers.

4. The image forming apparatus according to claim 1, wherein the power supplying part comprises:

a pulse power generating circuit which generates the pulse power; and, a direct current power generating circuit which generates power having a polarity opposite to the polarity of the charged toner.

5. The image forming apparatus according to claim 4, wherein the control part connects the pulse power generating circuit to one of the plurality of transfer rollers, and connects the direct current power generating circuit to another of the plurality of transfer rollers.

6. The image forming apparatus according to claim 4, further comprising a power switching part which is interposed between the power supplying part and the transfer rollers to switch between power supplied from the pulse power generating circuit and the direct current power generating circuit of the power supplying part, wherein the control part controls the power switching part to connect the direct current power generating circuit to each of the plurality of transfer rollers during printing, and to connect the pulse power generating circuit to at least one of the transfer rollers during cleaning of the remaining toner.

7. The image forming apparatus according to claim 6, wherein the control part connects the pulse power generating circuit to one or more of the transfer rollers and connects the direct current power generating circuit to one or more of the transfer rollers during the cleaning of the remaining toner.

8. An image forming apparatus, comprising:

a belt;

a plurality of support rollers which rotatably supports the belt;

a photosensitive medium which has a surface on which a visible toner image is formed by charged toner;

a transfer roller which is disposed adjacent to the photosensitive medium with the belt interposed therebetween;

a power supplying part which supplies power to the transfer roller so that a surface of the transfer roller has an electrical potential; and a control part which controls the power supplying part to supply a pulse power which has a middle power level having a same polarity as a polarity of the charged toner to the transfer roller so that the charged toner remaining on the belt is transferred back to the photosensitive medium;

wherein the charged toner is negatively charged and the pulse power comprises a pulse voltage having a maximum voltage which is equal to or less than +500V and a minimum voltage which is equal to or greater than −3,000V.

9. An image forming apparatus, comprising:

a belt;

a plurality of support rollers which rotatably supports the belt;

a plurality of photosensitive media, each having a surface on which a visible toner image is formed by charged toner;

a plurality of transfer rollers disposed adjacent to the photosensitive media with the belt interposed therebetween;

a power supplying part which supplies power to at least one of the plurality of transfer rollers so that a surface of the at least one of the plurality of transfer rollers have an electrical potential; and a control part which controls the power supplying part to supply a pulse power which has a middle power level having a same polarity as a polarity of the charged toner to the at least one of the plurality of transfer rollers so that the charged toner remaining on the belt is transferred back to at least one of the plurality of photosensitive media;

wherein the control part controls the power supplying part to supply one of the plurality of transfer rollers with a pulse power having a different amplitude from an amplitude of a pulse power supplied to another one of the plurality of transfer rollers during a cleaning operation to clean the toner from the belt.

10. The image forming apparatus according to claim 9, wherein the belt is provided to transfer a printing medium past the photosensitive media and the control part controls the power supplying part to supply pulse power having increasing amplitudes to the respective transfer rollers along a direction in which the printing medium is transferred past the photosensitive media by the belt.

11. An image forming apparatus, comprising:

a belt;

a plurality of support rollers which rotatably supports the belt;

a photosensitive medium which has a surface on which a visible toner image is formed by charged toner;

a transfer roller which is disposed adjacent to the photosensitive medium with the belt interposed therebetween;

a power supplying part which supplies power to the transfer roller so that a surface of the transfer roller has an electrical potential; and a control part which controls the power supplying part to supply a pulse power which has a middle power level having a same polarity as a polarity of the charged toner to the transfer roller so that the charged toner remaining on the belt is transferred back to the photosensitive medium;

wherein the toner is positively charged, and the pulse power comprises a pulse voltage having a maximum voltage which is equal to or less than +3,000V, and a minimum voltage which is equal to or greater than −500V.

12. A method of removing toner from a belt which is driven by a plurality of support rollers in an image forming apparatus, the image forming apparatus comprising a photosensitive medium having a surface on which a visible toner image is formed by charged toner and a transfer roller which is disposed adjacent to the photosensitive medium with the belt interposed therebetween, the method comprising:

determining whether to remove toner remaining on the belt; and if the determining indicates that the toner remaining on the belt should be removed, generating a pulse power having an average value which has a same polarity as a polarity of the toner, and supplying the pulse power to the transfer roller;

wherein the pulse power comprises a pulse voltage having a maximum voltage which is equal to or less than +500V, and a minimum voltage which is equal to or greater than −3,000V.

13. The method according to claim 12, wherein the image forming apparatus comprises a plural number of the transfer roller and the photosensitive medium, and the supplying of the pulse power comprises supplying the pulse power to at least one of the plurality of transfer rollers.

14. The method according to claim 13, wherein the belt is provided to transfer a printing medium past the photosensitive media and the supplying of the pulse power further comprises respectively supplying pulse powers having increasing amplitudes to each of the plurality of transfer rollers in a direction in which the printing medium is transferred past the photosensitive media by the belt.

15. The method according to claim 13, wherein the supplying of the pulse power further comprises supplying the pulse power to at least one but less than all of the plurality of transfer rollers.

16. The method according to claim 15, wherein the supplying of the pulse power further comprises supplying power which has a polarity opposite to the polarity of the charged toner to one of the plurality of transfer rollers.

17. An image forming apparatus, comprising:

a belt;

a photosensitive medium which has a surface on which a visible toner image is formed by charged toner;

a transfer roller which is disposed adjacent to the photosensitive medium with the belt interposed therebetween; and a power supplying part which supplies electric power to the transfer roller to repel the charged toner off the belt, wherein the electric power comprises a pulse voltage with positive and negative components which are supplied according to negative and positive amounts of the charged toner remaining on the belt;

wherein the pulse voltage has a maximum voltage which is equal to or less than +500V, and a minimum voltage which is equal to or greater than −3,000V.

18. A method of removing toner from a belt which is driven by a plurality of support rollers and transfers a printing medium in an image forming apparatus, the image forming apparatus comprising a photosensitive medium having a surface on which a visible toner image is formed by charged toner and a transfer roller which is disposed adjacent to the photosensitive medium with the belt interposed therebetween, the method comprising:

supplying power to the transfer roller to repel the charged toner off the belt, wherein the power comprises a pulse power with positive and negative components which are supplied according to negative and positive amounts of the charged toner remaining on the belt;

wherein the pulse voltage has a maximum voltage which is equal to or less than +500V, and a minimum voltage which is equal to or greater than −3,000V.

19. The method according to claim 18, further comprising storing a determination condition which indicates whether to initiate the supplying of the power.

20. The method according to claim 19, wherein the determination condition is based on a number of the printing media which have been printed or a length of printing time.

* * * * *